US009414148B2

(12) United States Patent
Huang et al.

(10) Patent No.: US 9,414,148 B2
(45) Date of Patent: Aug. 9, 2016

(54) EAR-HUGGING NOISE-REDUCING HEADPHONES

(71) Applicant: Jetvox Acoustic Corp., Taoyuan (TW)

(72) Inventors: To-Teng Huang, Taoyuan (TW); Shun-Peng Lin, Taoyuan (TW)

(73) Assignee: JETVOX ACOUSTIC CORP., Taoyuan (TW)

( * ) Notice: Subject to any disclaimer, the term of this patent is extended or adjusted under 35 U.S.C. 154(b) by 0 days.

(21) Appl. No.: 14/665,524

(22) Filed: Mar. 23, 2015

(65) Prior Publication Data

US 2015/0296287 A1 Oct. 15, 2015

(30) Foreign Application Priority Data

Apr. 11, 2014 (TW) ..... 103206416 U

(51) Int. Cl.

| | |
|---|---|
| ***H04R 1/02*** | (2006.01) |
| ***H04R 1/10*** | (2006.01) |
| ***H04R 1/24*** | (2006.01) |
| ***H04R 1/08*** | (2006.01) |

(52) U.S. Cl.

CPC ..... *H04R 1/1083* (2013.01); *H04R 1/08* (2013.01); *H04R 1/24* (2013.01); *H04R 1/1008* (2013.01); *H04R 2201/107* (2013.01)

(58) Field of Classification Search

None

See application file for complete search history.

(56) References Cited

U.S. PATENT DOCUMENTS

| | | | | |
|---|---|---|---|---|
| 5,402,497 | A * | 3/1995 | Nishimoto | H04R 1/1083 381/74 |
| 6,993,140 | B1 * | 1/2006 | Chen | G10K 11/1782 381/71.6 |
| 7,251,335 | B1 * | 7/2007 | Chen | H04R 1/1083 381/71.6 |
| 7,466,838 | B1 * | 12/2008 | Moseley | H04R 1/1008 381/370 |
| 8,861,766 | B2 * | 10/2014 | Ouryouji | H04R 1/1058 381/370 |
| 2003/0095670 | A1 * | 5/2003 | Wurtz | G10K 11/1784 381/71.6 |
| 2007/0154049 | A1 * | 7/2007 | Levitsky | H04R 1/1083 381/371 |
| 2011/0286607 | A1 * | 11/2011 | Kimura | H04R 1/1083 381/71.6 |

* cited by examiner

*Primary Examiner* — Thang Tran

(74) *Attorney, Agent, or Firm* — Muncy, Geissler, Olds & Lowe, P.C.

(57) ABSTRACT

Ear-hugging noise-reducing headphones include a protective body, a speaker assembly, and a microphone unit. The protective body includes a first convex portion, a second convex portion, and a third convex portion. The first convex portion and the second convex portion are protruded from a first surface of the protective body. The third convex portion is protruded from a second surface of the protective body. The first convex portion and the third convex portion define a first accommodating space. The second convex portion defines a second accommodating space. The speaker assembly is disposed in the first accommodating space. The microphone unit is disposed in the second accommodating space. The speaker assembly includes a circuit component and a speaker unit. Audio lines are connected to the speaker unit and the microphone unit by the circuit component. The microphone unit is close to an ear canal of user.

9 Claims, 6 Drawing Sheets

EAR-HUGGING NOISE-REDUCING HEADPHONES

CROSS-REFERENCES TO RELATED APPLICATIONS

This non-provisional application claims priority under 35 U.S.C. §119(a) on Patent Application No. 103206416 filed in Taiwan, R.O.C. on 2014 Apr. 11, the entire contents of which are hereby incorporated by reference.

BACKGROUND

1. Technical Field

The instant disclosure relates to headphones, and more particularly, to ear-hugging noise-reducing headphones integrating a microphone to a protective body and facing toward an ear canal of a user.

2. Related Art

In some circumstances such as client servicing, sporting, car driving, and on-line game playing, there are a need for listening and talking to other people at the same time by using integrated headphones which combine headphones and microphones. Integrated headphones available on the market are either adopting Bluetooth communication system for wireless connection or using audio lines for direct connection between headphones and microphones. Integrated headphones can be utilized for listening and talking to people at the same time such that users have no need to replace any physical components of the integrated headphones.

Considering from which the voices come, the microphone of the integrated headphones is usually arranged below the headphones and close to a side of the mouth of user. The microphone located at the position close to the mouth of user is easily affected by vibrations of speaker diaphragms of the headphones, wind noises from outside, and breath noises from user. Communications of the integrated headphones easily generate noise signals, and qualities with respect to either listening or talking are interfered.

Thus, there is a need for developing integrated headphones capable of reducing noise generated by backward waves from speakers thereof, and suiting both indoor and outdoor usage.

SUMMARY

To address the above issue, the instant disclosure provides ear-hugging noise-reducing headphones comprising a protective body, a speaker assembly, and a microphone unit. The protective body comprises a first convex portion, a second convex portion, and a third convex portion. The first convex portion and the second convex portion are both hollow columns protruded from a first surface of the protective body. The third convex portion is protruded from a second surface of the protective body opposite to the first surface, and corresponds to the position of the first convex portion. The first convex portion is opposite to and communicates with the third convex portion. The first convex portion and the third convex portion mutually define a first accommodating space. The second convex portion defines a second accommodating space. The first surface is close to an ear canal of a user.

A front cover is disposed on the first surface and on the first convex portion. A rear cover and a sealing cover are disposed on the second surface. The rear cover is disposed on the second convex portion. The rear cover and the front cover mutually seal the first accommodating space. The sealing cover is disposed on the second surface of the protective body and seals a single side of the second accommodating space.

The speaker assembly is disposed in the first accommodating space. The microphone unit is disposed in the second accommodating space. The speaker assembly comprises a circuit component and a speaker unit. The circuit component is connected to a plurality of audio lines. The circuit component and the speaker unit are assembled to each other. The audio lines are connected to the speaker unit and the microphone unit by the circuit component.

The voices that the user pronounces actually have an acoustic resonance in a position near the ear canal of the user so that the microphone unit is disposed on the inner side of the headphones and close to the ear canal of the user. The speaker unit and the microphone unit are both protruded from the first surface of the protective body and are disposed in the accommodating spaces. The accommodating spaces can be utilized for enhancing the effect of low frequency response. Therefore, the resolution of the sound generated by the headphones is increased. Even using the headphones outdoors or during walking, the microphone unit is not easily affected by the vibration of outside air so that noises are reduced.

The features of the instant disclosure will no doubt become understandable to those of ordinary skill in the art after reading the following detailed description of the preferred embodiment that is illustrated in the various figures and drawings.

DETAILED DESCRIPTION

Figure 1:
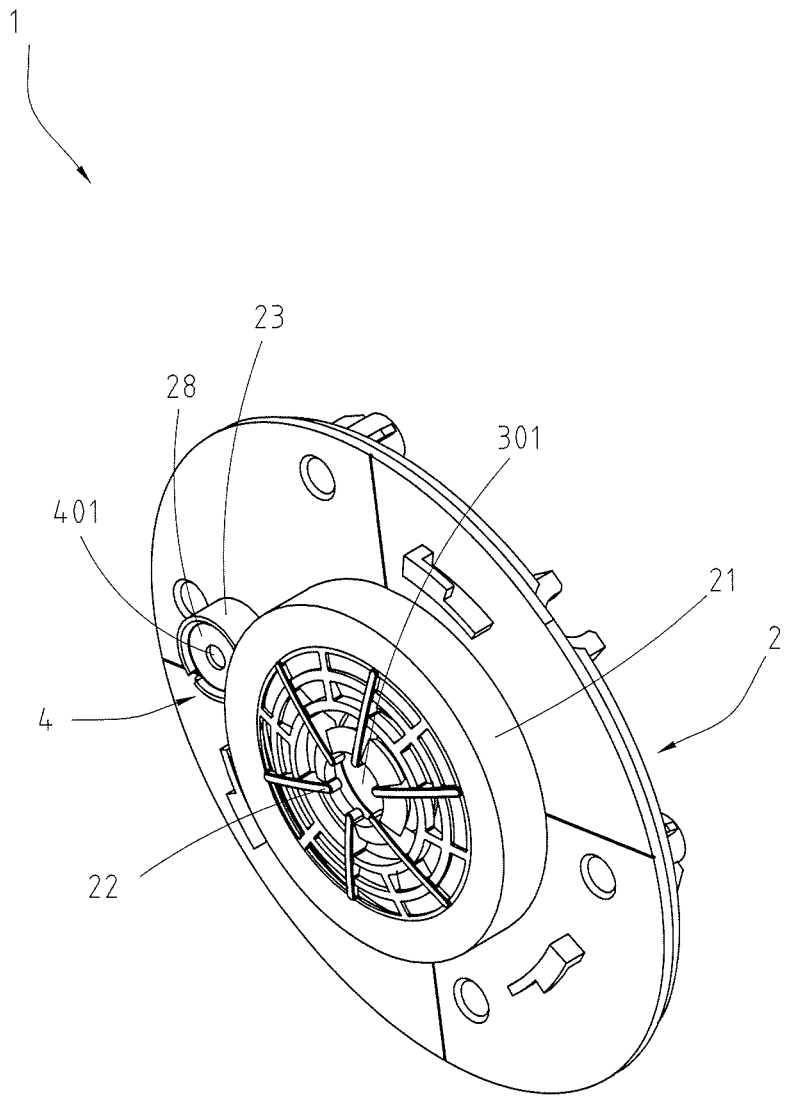
FIG. 1 illustrates a front perspective view of one of two ear sides of ear-hugging noise-reducing headphones according to an embodiment of the instant disclosure.
Figure 2:
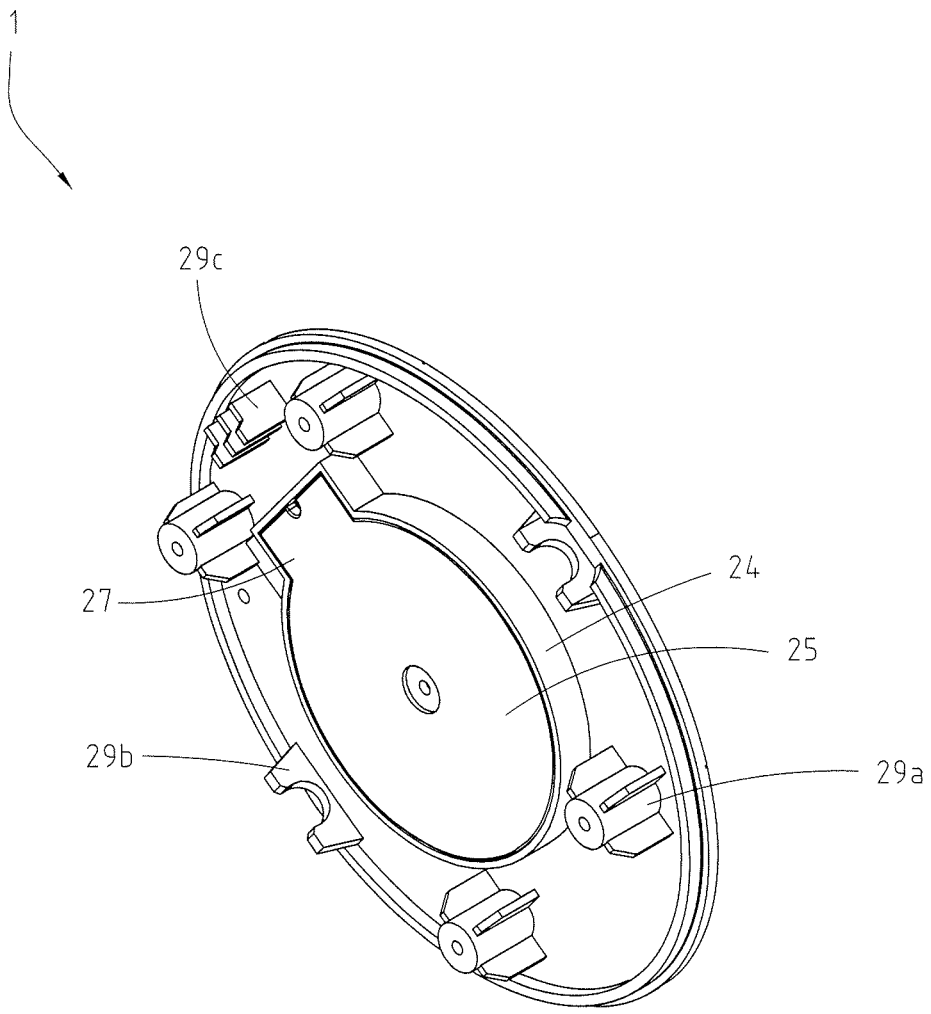
FIG. 2 illustrates a rear perspective view of one of two ear sides of the ear-hugging noise-reducing headphones according to the embodiment of the instant disclosure.
Figure 3:
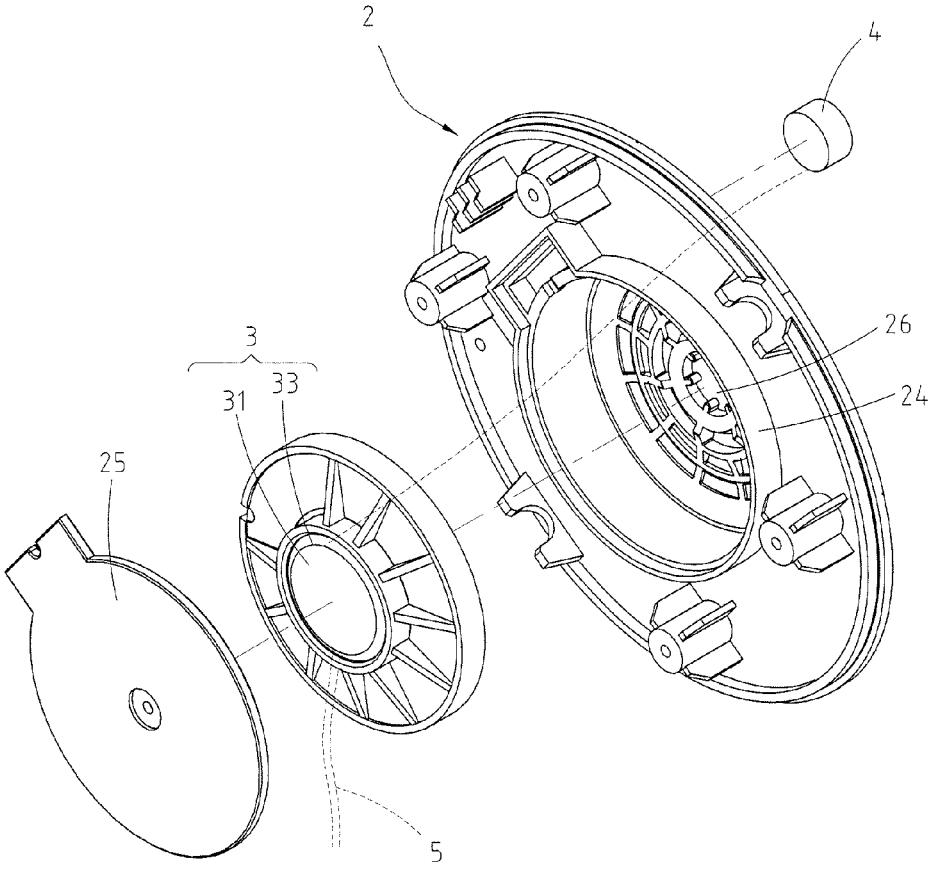
FIG. 3 illustrates an exploded view of one of two ear sides of the ear-hugging noise-reducing headphones according to the embodiment of the instant disclosure.

Referring to FIG. 1 to FIG. 3, FIG. 1 to FIG. 3 are respectively illustrate a front perspective view, a rear perspective view, and an exploded view of one of two ear sides of ear-hugging noise-reducing headphones 1 according to an embodiment of the instant disclosure. As shown in FIG. 1 to FIG. 3, the ear-hugging noise-reducing headphones 1 of the embodiment of the instant disclosure comprises a protective body 2, a speaker assembly 3, and a microphone unit 4 for picking up sound. The protective body 2 has a substantial flat plate shape such as a circular flat plate. A first surface of the protective body 2 includes a first convex portion 21. The first convex portion 21 is a hollow column protruded vertically from the center of the first surface of the protective body 2. The first convex portion 21 is covered by a front cover 22. The front cover 22 can have a net shape. The first surface of the protective body 2 further includes a second convex portion 23 arranged below and in the lower left or the lower right direction away from the first convex portion 21. An extending direction of the second convex portion 23 is parallel to that of the first convex portion 21. The second convex portion 23 is also a hollow column.

A second surface of the protective body 2 includes a third convex portion 24 which is protruded from the second surface and is corresponding to the position of the first convex portion 21. An inner side of the third convex portion 24 is assembled with a rear cover 25. The first convex portion 21 and the third convex portion 24 communicate with each other and mutually define a first accommodating space 26. The second convex portion 23 defines a second accommodating space 28. Two sides of the first accommodating space 26 are respectively sealed by the front cover 22 and the rear cover 25. The second accommodating space 28 is covered by the rear cover 25.

The speaker assembly 3 is disposed in the first accommodating space 26. A sealing cover 27 is disposed on the second surface of the protective body 2 and is corresponding to the position of the second convex portion 23. In the embodiment, the sealing cover 27 is, but is not limited to, an extending part of the rear cover 25. The sealing cover 27 seals a single side of the hollow column (i.e., a side of the second accommodating space 28). The microphone unit 4 is disposed in the second accommodating space 28. The first surface is close to an ear canal of a user.

The speaker assembly 3 comprises a circuit component 31 and a speaker unit 33. The circuit component 31 is connected to a plurality of audio lines 5. The circuit component 31 and the speaker unit 33 are assembled to each other. The audio lines 5 are connected to the speaker unit 33 and the microphone unit 4 by the circuit component 31.

Figure 4:
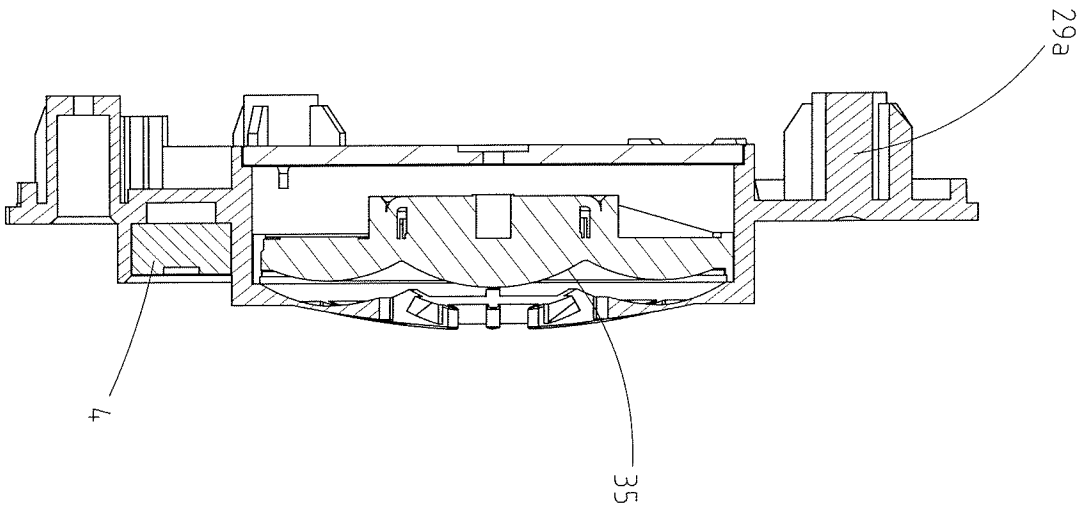
FIG. 4 illustrates a cross-sectional view of one of two ear sides of the ear-hugging noise-reducing headphones according to the embodiment of the instant disclosure.

Referring to FIG. 4, FIG. 4 illustrates a cross-sectional view of one of two ear sides of the ear-hugging noise-reducing headphones 1 according to the embodiment of the instant disclosure. The positions of the speaker assembly 3 and the microphone unit 4 are both protruded from the first surface of the protective body 2. The first accommodating space 26 is utilized for enhancing the response of a cavity. In general, the resolution of the low frequency response of the headphones 1 is increased and is clearer. When the user uses the headphones 1, the microphone unit 4 and a speaker diaphragm 35 of the speaker unit 33 are located at a same vertical line such that the microphone unit 4 is closer to the position of the ear canal of the user.

Figure 5:
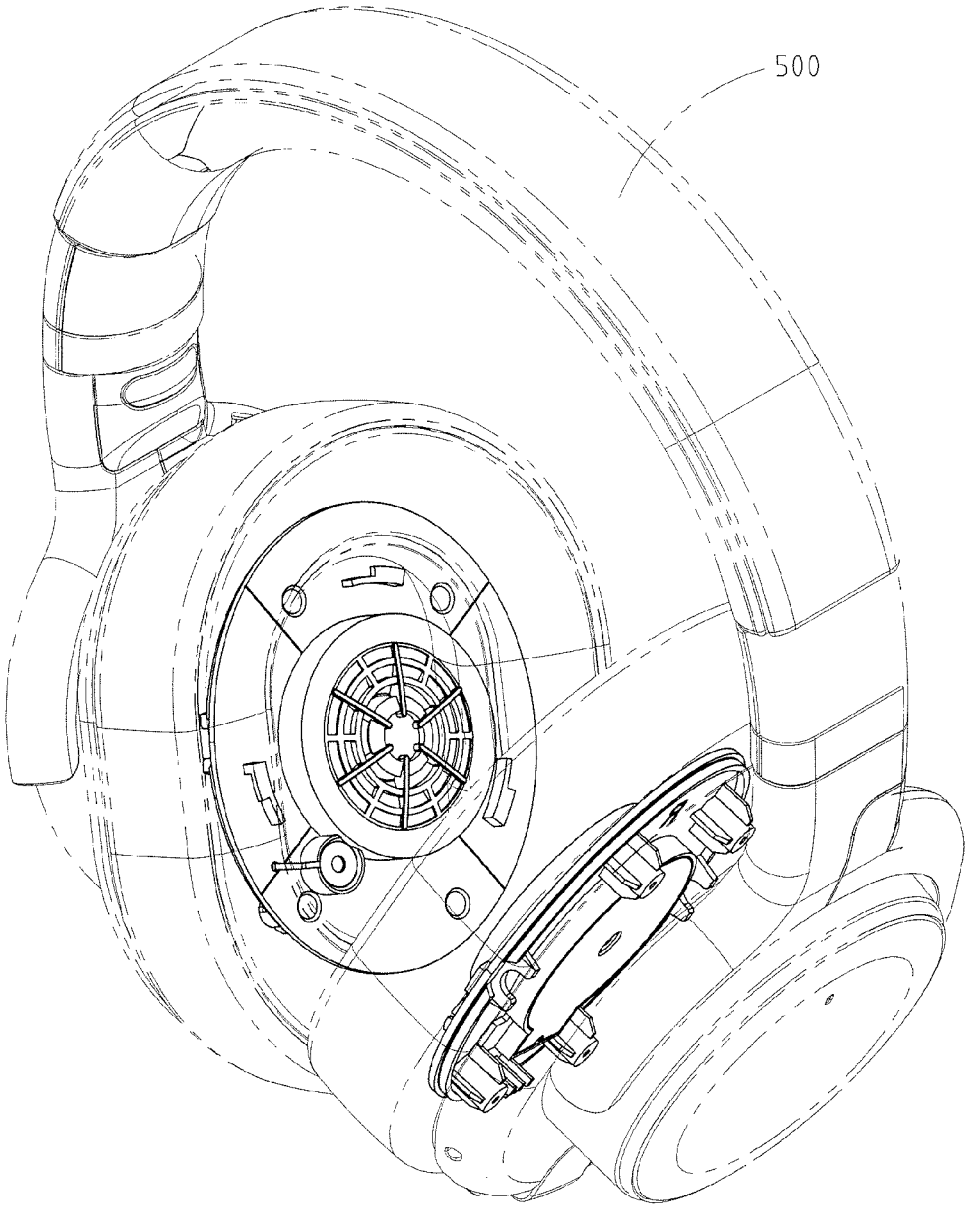
FIG. 5 illustrates a perspective view of the whole of the ear-hugging noise-reducing headphones according to the embodiment of the instant disclosure.

Referring to FIG. 2, the protective body 2 further comprises a plurality of assembling portions such as the first assembling portion 29*a*, the second assembling portion 29*b*, and the third assembling portion 29*c* for being connected to an external housing 500 and then being assembled as the ear-hugging headphones 1, as shown in FIG. 5.

Figure 6:
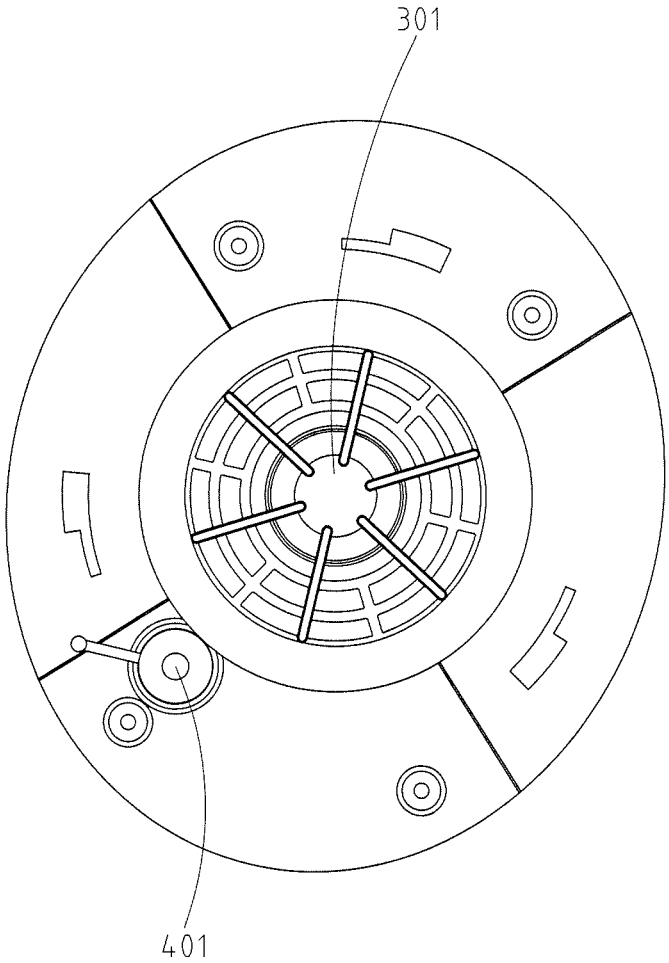
FIG. 6 illustrates a configuration showing relative positions of a speaker assembly and a microphone unit of the right ear side of the ear-hugging noise-reducing headphones according to the embodiment of the instant disclosure.

Referring to FIG. 6, FIG. 6 illustrates a configuration showing relative positions of the speaker assembly 3 and the microphone unit 4 of the right ear side of the ear-hugging noise-reducing headphones 1 according to the embodiment of the instant disclosure. The center 401 of the microphone unit 4 is located at the lower left side, about seven o'clock direction, relating to the center 301 of the speaker assembly 3 in the right ear side of the headphones 1. The connecting line between the center 301 of the speaker assembly 3 and the center 401 of the microphone unit 4 and the horizontal line passing through the center 301 of the speaker assembly 3 define an included angle ranging from 15 degrees to 70 degrees. Regarding the left ear side of the headphones 1, it is understandable and has no need to depict a redundant drawing that the center 401 of the microphone unit 4 is accordingly located at the lower right side, about five o'clock direction, relating to the center 301 of the speaker assembly 3.

The features of the instant disclosure are described below. The speaker assembly and the microphone unit are both protruded from the first surface of the protective body. The accommodating spaces can be utilized for enhancing the effect of low frequency response. Furthermore, the microphone unit is arranged to be close to the ear canal of the user, and is also close to the position of human body in which an acoustic resonance usually happens. Therefore, even the user uses the headphones outdoors or during walking, the microphone unit is still not easily affected by the vibration of outside air so that noises are effectively reduced.

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. Ear-hugging noise-reducing headphones, comprising:

a protective body comprising a first convex portion, a second convex portion, and a third convex portion, wherein the first convex portion is a hollow column protruded vertically from the center of a first surface of the protective body, the second convex portion is a hollow column protruded vertically from the first surface and the second convex portion is arranged below and in the lower left or the lower right direction away from the first convex portion, the third convex portion is protruded from a second surface of the protective body corresponding to the position of the first convex portion, the first convex portion and the third convex portion mutually define a first accommodating space, and the second convex portion defines a second accommodating space;

a microphone unit disposed in the second accommodating space; and a speaker assembly comprising a circuit component and a speaker unit, wherein the circuit component is connected to a plurality of audio lines, the circuit component and the speaker unit are assembled to each other, and the audio lines are connected to the speaker unit and the microphone unit by the circuit component;

wherein the first surface faces toward an ear canal of a user.

2. The ear-hugging noise-reducing headphones of claim 1, further comprise a front cover, a rear cover, and a sealing cover, wherein the front cover is disposed on the first convex portion, the rear cover is disposed on the third convex portion, the rear cover and the front cover mutually seal the first accommodating space, and the sealing cover is disposed on the second surface of the protective body and seals a single side of the second accommodating space.

3. The ear-hugging noise-reducing headphones of claim 2, wherein the front cover has a net shape.

4. The ear-hugging noise-reducing headphones of claim 1, wherein when the user uses the ear-hugging noise-reducing headphones, the microphone unit and a speaker diaphragm of the speaker unit are located at a same vertical line.

5. The ear-hugging noise-reducing headphones of claim 1, wherein the center of the microphone unit is located at the lower left side relating to the center of the speaker assembly in the right ear side of the ear-hugging noise-reducing headphones.

6. The ear-hugging noise-reducing headphones of claim 1, wherein the center of the microphone unit is located at the lower right side relating to the center of the speaker assembly in the left ear side of the ear-hugging noise-reducing headphones.

7. The ear-hugging noise-reducing headphones of claim 5, wherein the connecting line between the center of the microphone unit and the center of the speaker assembly and the horizontal line passing through the center of the speaker assembly define an included angle ranging from 15 degrees to 70 degrees.

8. The ear-hugging noise-reducing headphones of claim 6, wherein the connecting line between the center of the microphone unit and the center of the speaker assembly and the horizontal line passing through the center of the speaker assembly define an included angle ranging from 15 degrees to 70 degrees.

9. The ear-hugging noise-reducing headphones of claim 1, wherein the protective body further comprises a plurality of assembling portions for being connected to an external housing.

* * * * *